US006571714B1

(12) United States Patent
Brum et al.

(10) Patent No.: US 6,571,714 B1
(45) Date of Patent: Jun. 3, 2003

(54) SILICON WINDOW INFRARED AUGMENTER

(75) Inventors: Roger D. Brum, Irvine, CA (US); David H. Smith, Irvine, CA (US)

(73) Assignee: Meggitt Defense Systems, Tustin, CA (US)

( * ) Notice: Subject to any disclaimer, the term of this patent is extended or adjusted under 35 U.S.C. 154(b) by 0 days.

(21) Appl. No.: 10/034,563

(22) Filed: Dec. 26, 2001

(51) Int. Cl.[7] ..... H01Q 15/08; H01Q 15/12
(52) U.S. Cl. ..... 102/336; 342/6; 342/9
(58) Field of Search ..... 102/336; 342/6, 342/9

(56) References Cited

U.S. PATENT DOCUMENTS

| | | | | |
|---|---|---|---|---|
| 2,381,130 A | | 8/1945 | Lloyd | 102/336 |
| 2,448,343 A | | 8/1948 | Zandmer | 102/517 |
| 2,551,596 A | | 5/1951 | Haglund | 244/3 |
| 2,813,719 A | | 11/1957 | Hopper | 273/361 |
| 2,907,536 A | | 10/1959 | Vonzborowski | 244/12.1 |
| 2,923,549 A | | 2/1960 | Hopper et al. | 244/1 TD |
| 2,953,377 A | | 9/1960 | Brust | 102/384 |
| 2,998,754 A | | 9/1961 | Bialy | 89/1.816 |
| 3,002,708 A | | 10/1961 | Wetzel et al. | 244/3 |
| 3,135,511 A | | 6/1964 | Norman et al. | 244/136 |
| 3,225,655 A | | 12/1965 | Inglis | 89/1.816 |
| 3,410,559 A | | 11/1968 | Miller, Jr. | 431/328 |
| 3,505,926 A | | 4/1970 | Johnson | 102/504 |
| 3,610,096 A | | 10/1971 | Bauman et al. | 89/1.808 |
| 3,720,167 A | | 3/1973 | Mainhardt et al. | 102/350 |
| 3,808,941 A | | 5/1974 | Biggs | 89/1.51 |
| 3,871,321 A | | 3/1975 | Biebel et al. | 114/221 A |
| 3,898,661 A | | 8/1975 | Kelly et al. | 342/12 |
| 3,899,975 A | | 8/1975 | Lawrence | 102/505 |
| 3,932,057 A | | 1/1976 | Wadensten | 366/124 |
| 4,062,112 A | | 12/1977 | Lake | 86/50 |
| 4,134,008 A | * | 1/1979 | de Corlieu et al. | 359/170 |
| 4,135,027 A | * | 1/1979 | Anthony et al. | 428/195 |
| 4,140,433 A | | 2/1979 | Eckel | 415/209.1 |
| 4,195,571 A | | 4/1980 | Becker et al. | 102/505 |
| 4,205,848 A | | 6/1980 | Smith et al. | 273/361 |
| 4,406,227 A | | 9/1983 | Becker et al. | 102/505 |
| 4,428,583 A | | 1/1984 | Feagle | 273/348.1 |
| 4,446,793 A | | 5/1984 | Gibbs | 102/505 |
| 4,599,537 A | * | 7/1986 | Yamashita | 313/501 |
| 4,607,849 A | | 8/1986 | Smith et al. | 273/348.1 |
| 4,718,320 A | | 1/1988 | Brum | 89/1.11 |
| 4,770,368 A | | 9/1988 | Yates et al. | 244/1 TD |
| 4,796,536 A | | 1/1989 | Yu et al. | 102/505 |
| 4,852,455 A | | 8/1989 | Brum | 89/1.14 |
| 4,860,657 A | | 8/1989 | Steinicke et al. | 102/334 |
| 4,899,662 A | | 2/1990 | Santalucia et al. | 102/505 |
| 5,074,216 A | | 12/1991 | Dunne et al. | 102/334 |
| 5,077,143 A | * | 12/1991 | Barraclough et al. | 428/690 |
| 5,179,778 A | | 1/1993 | Dickson et al. | 29/876 |
| 5,249,924 A | | 10/1993 | Brum | 416/48 |
| 5,312,521 A | * | 5/1994 | Fraas et al. | 136/253 |

(List continued on next page.)

FOREIGN PATENT DOCUMENTS

| | | |
|---|---|---|
| DE | 1229397 | 11/1966 |
| FR | 1336769 | 7/1963 |

OTHER PUBLICATIONS

Defense Electronics; "Expandable Decoys Counter Missle with New Technology"; Oct. 1986.

*Primary Examiner*—Peter A. Nelson
(74) *Attorney, Agent, or Firm*—Stetina Brunda Garred & Brucker

(57) ABSTRACT

There is provided an electrically powered augmenter device that has a silicon window. The silicon window emits the infrared radiation from the augmenter in a specific waveband, to attract heat seeking missles. Moreover, the augmenter may be mounted on the fuselage of an unpowered aerial towed target or other airborne vehicle.

20 Claims, 2 Drawing Sheets

U.S. PATENT DOCUMENTS 5,319,373 A * 6/1994 Maxwell et al. ..... 342/55
5,445,078 A 8/1995 Marion ..... 102/505
5,488,371 A * 1/1996 Targove ..... 342/1
5,497,156 A * 3/1996 Bushman ..... 342/9
5,499,582 A 3/1996 Schiessl et al. ..... 102/334
5,639,984 A * 6/1997 Nielson ..... 102/336
5,670,959 A * 9/1997 Nagura et al. ..... 342/6
5,680,136 A * 10/1997 Chekroun ..... 342/6
5,693,907 A * 12/1997 Rudnik ..... 102/293
5,915,694 A 6/1999 Brum ..... 102/505
6,204,083 B1 * 3/2001 Kodato et al. ..... 438/43

* cited by examiner

SILICON WINDOW INFRARED AUGMENTER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to aerial targets, and more particularly to an improved aerial target decoy which simulates an exhaust of a jet engine through use of an infrared augmenter device having a silicon window.

The use of aerial targets to enhance military weapons training is well known. As shown in FIG. 1, aircraft typically tow these aerial targets so that they duplicate battle targets (e.g., enemy aircraft). By providing a scenario which closely resembles a real-life battle situation, target-striking weapons such as anti-aircraft missiles can be launched thereagainst so as to optimize their use and operation.

Certain types of aerial targets utilized in the military weapons training are adapted for more sophisticated weaponry such as heat-seeking missiles. These types are not only designed to provide visual indications of the targets' locations, but further emit infrared thermal; signatures. In this respect, military weaponry such as heat-seeking missiles can trace and follow the thermal signatures to strike and destroy those targets that emit them. By incorporating these types of aerial targets into the military weapons training, the operation and use of heat-seeking weaponry can be significantly improved in preparation for real-life situations.

Traditionally, gas or liquid fuel powered aerial targets have been used to achieve this purpose. These fuel-burning targets typically operate to heat a mesh or to create an external flame which radiates sufficient thermal signature. However, because such targets require fuel tanks, plumbing, valves and an ignition source, they are complicated and expensive. They also are limited in altitude and airspeed of operation. A further disadvantage is that their infrared emission is primarily directed aft. Thus, they are poorly suited in training pilots to attack an enemy heading toward them.

One known solution to this problem is the use of aerial targets manufactured by Global Target Systems Limited of Challock, Great Britain. Generally, a typical aerial target from Global comprises an enclosed housing which places a heater unit therein to selectively emit thermal signatures through its window. Although its targets are believed to be proven effective for their intended purpose, they are extremely expensive to manufacture. Simply put, these targets are too impractical as to cost to serve as one-time target designations.

Perhaps the greatest cost factor in manufacturing Global's aerial targets is the use of zinc-sulphide windows in their targets. In particular, Global's use of zinc-sulphide windows is due to the fact that they allow frequencies of infrared to radiate therethrough which can be readily detected by heat-seeking weaponry. However, these windows are extremely costly, not to mention that they are often difficult to obtain and/or fabricate. This becomes a tremendous factor when considering that aerial targets, by their inherent nature, are manufactured to be used for one-time target practice.

In view of the above-described shortcomings of conventional aerial targets, there exists a need in the art for an aerial target which can be economically manufactured. More specifically, there exists a need for an aerial target adapted for heat-seeking weaponry which generates and emits the required infrared thermal signature therefor, while being mass-producible with mitigated costs.

BRIEF SUMMARY OF THE INVENTION

The present invention specifically addresses and alleviates the above-referenced deficiencies associated with the use of aerial targets of the prior art. More particularly, the present invention is an improved aerial target which simulates an exhaust of a jet engine through use of an infrared augmenter device having a silicon window. This specific augmenter of the present invention is designed to continuously output the required infrared thermal signature in the forward direction as it is advantageously insensitive to mounting orientation. In addition, it is advantageously insensitive to airspeed and altitude. More importantly, however, the present invention's aerial target decoy uses a silicon window to radiate detectable infrared frequencies therethrough, which is significantly cheaper and more easily obtainable than the conventional windows performing the same.

In accordance with a preferred embodiment of the present invention, there is provided an unpowered aerial target for emitting an infrared thermal signature in a specific waveband range (about 3 to 5 microns) when being towed by an aircraft. The present invention features an infrared augmenter device which is engaged to the forward end of a fuselage. However, because the present augmenter device is adapted to consistently emit thermal signature through its window, it would be recognized that the augmenter can be placed any desired location defined on the fuselage.

In the preferred embodiment of the present invention, the silicon window may be incorporated into the infrared augmenter device in any sensible fashion, whether it be via conventional or creative means. Preferably, however, the silicon window is mounted in the front end of the augmenter device by an O-ring that acts like a snap-ring. This manner of attachment is further preferred as it helps prevent outside dust and moisture from entering within the device.

In operation, an aircraft may tow the present invention's aerial target by connecting elongated tow line to the target. By doing so, the target becomes airborne but should be far enough from the aircraft (about 2 miles) so that any incoming missiles do not inadvertently harm the aircraft. When airborne, the infrared augmenter device is operative to electrically generate high-intensity heat (about 1,400°F.) therewithin whereat its silicon window allows continuous emission of required infrared signatures of approximately 40 watts per steradian in the 3–5 micron waveband. In this respect, military weaponry such as heat-seeking missiles can be launched to trace these signatures for the purpose of striking and destroying the aerial target that emits them.

BRIEF DESCRIPTION OF THE DRAWINGS

These as well as other features of the present invention will become more apparent upon reference to the drawings wherein.

DETAILED DESCRIPTION OF THE INVENTION

Figure 1:
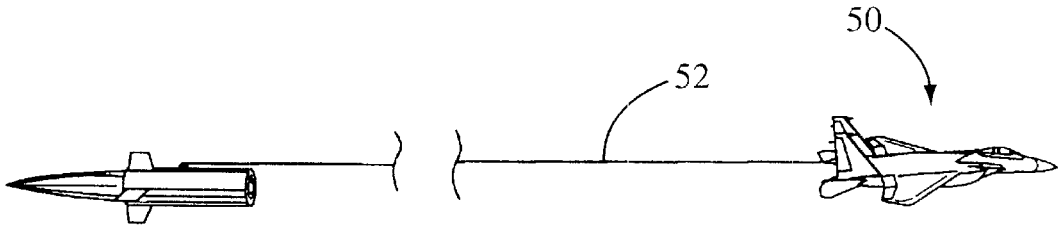
Fig. 1 (PRIOR ART)
FIG. 1 is a side view of an aircraft towing a prior art aerial target (not drawn to scale) when conducting a military weapons training.
Figure 2:
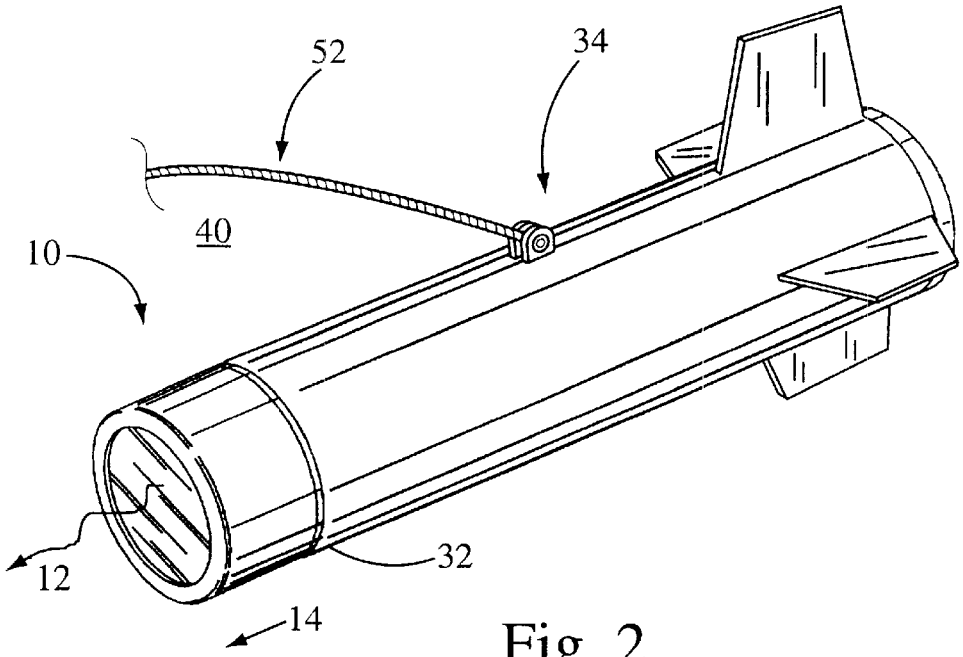
FIG. 2 is a perspective view of an aerial target utilized for emitting infrared thermal signatures constructed in accordance with a preferred embodiment of the present invention.

Referring now to the drawings wherein the showings are for purposes of illustrating preferred embodiments of the present invention only, and not for purposes of limiting the same, FIG. 2 perspectively illustrates an infrared augmenter device 10 constructed in accordance with a preferred embodiment of the present invention. As indicated above, the infrared augmenter device 10 is adapted to emit an infrared thermal signature 12 in the forward direction 14. Those of ordinary skill in the art will recognize that the augmenter device 10 may be formed to have a variety of shapes, configurations, geometries and sizes other than for that shown in the provided figures.

Figure 3:
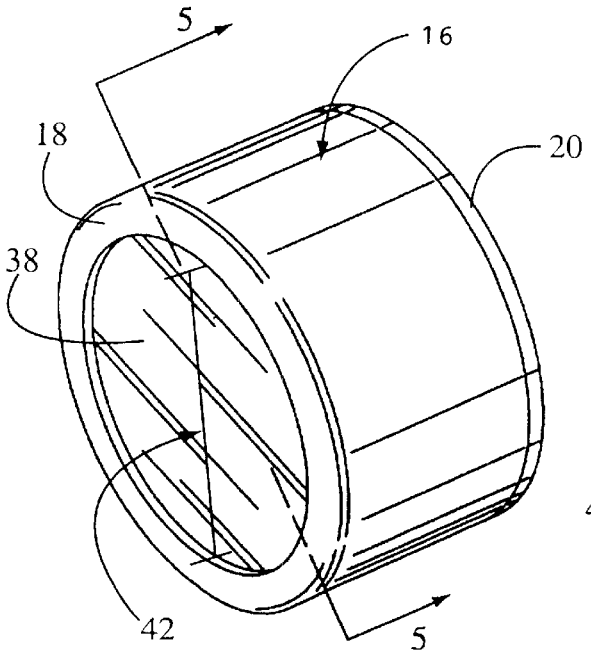
FIG. 3 is a perspective view of an infrared augmenter device featured in the aerial target of FIG. 2 and comprising a silicon window which is mounted therein.

As shown in FIG. 3, the infrared augmenter device 10 is enclosed in a housing 16. Although the housing 16 is shaped in a cylindrical configuration, such depiction is exemplary in nature and should not be limited thereto. The housing 16 may be fabricated from any material, but is preferably fabricated from a metallic material, and even more preferably aluminum.

Figure 4:
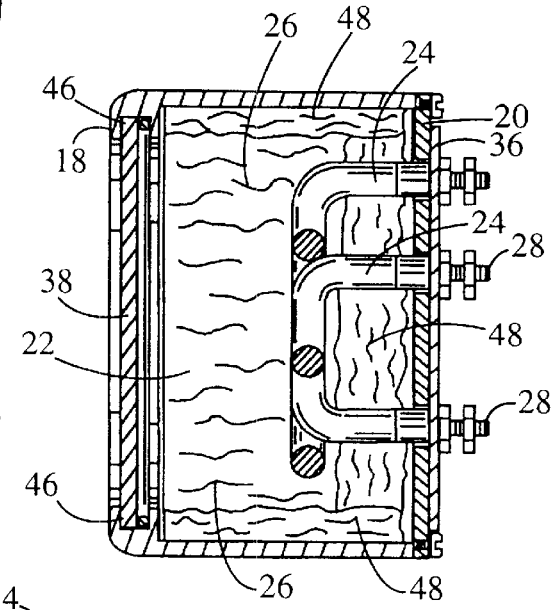
FIG. 4 is a cross-sectional view of the infrared augmenter device of FIG. 3 and illustrating its internally disposed heating elements.
Figure 5:
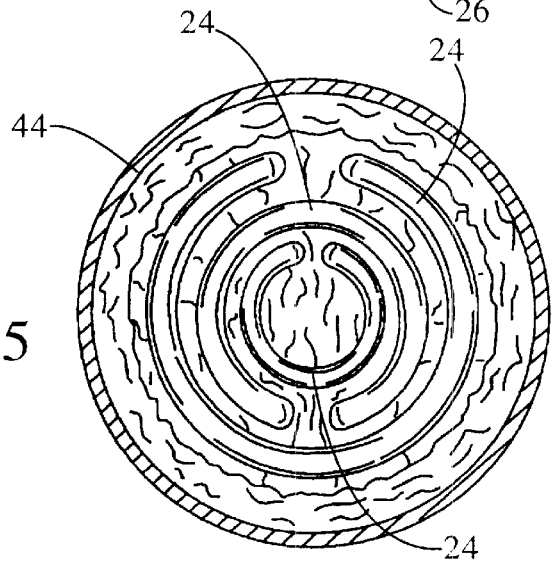
FIG. 5 is a cross-sectional view of the infrared augmenter device of FIG. 3 and illustrating layers of insulation which are strategically arranged therein.

Referring more particularly to FIGS. 4 and 5,there is provided a plurality of heating elements 24 that are disposed within the internal compartment 22 of the housing 16. It would be known to a person of ordinary skill in the art that the number of heating elements 24 may vary. For example, there could be only one heating element 24, or more than three. Rather, it is the concept of generating heat 26 within the internal compartment 22 that should be appreciated. In the preferred embodiment, however, three heating elements 24 should be used for optimization.

The three heating elements 24 are concentrically disposed within the internal compartment 22 of the housing 16 (best shown in FIG. 5). Although each of the heating elements 24 may be characterized by various shapes and configurations, the ones of the present invention each generally has an a circular configuration. These heating elements 24 further include electrical input terminals 28 which extend and protrude through the back end 20 of the housing 16 (as shown in FIG. 4). In this regard, the back end 20 is preferably a metallic backplate, and more particularly an aluminum backplate, which provides sufficient clearance holes 30 for the input terminals 28 to extend therethrough.

Referring now to FIGS. 2 and 4, the electrical input terminals 28 are in communication with an electrical power source 31 for supplying power thereto. More specifically, the heating elements 24 can be connected in parallel to the power source 31. These elements 24 can be sized for 28 VDC, or can be designed in a manner as to be adapted for any type of power. The power source may be located within the fuselage 34. In the alternative, the requisite electricity may be drawn from an outside power source such as from an aircraft 50 for example through an electrical cable which is elongated within the connecting tow line 52. Moreover, there is further provided an insulating plate 36 disposed between the back end 20 and the forward end 32 to which the electrical input terminals 28 are mounted.

Referring more particularly to FIGS. 3 and 4, the infrared augmenter device 10 comprises a window 38 which is preferably fabricated from silicon. It is expressly stated herein that the use of a silicon window to radiate detectable infrared signature 12 is both advantageous and imperative to the present invention as it is significantly cheaper, sufficiently rugged and more easily obtainable than the conventional windows (e.g., zinc-sulphide windows) performing the same.

Preferably, the silicon window 38 is mounted within an opening 42 of the housing's front end 18 by an O-ring that acts like a snap-ring and further simultaneously mitigating outside dust and moisture from entering within the device 10. However, it will be recognized by those of ordinary skill in the art that there are other methods of mounting the silicon window 38 within the housing 16.

The silicon window 38 is preferably an anti-reflective window. In this respect, the silicon window is coated with an anti-reflective material. Moreover, as shown in FIGS. 4 and 5, there may further comprise insulation layers 48 which are selectively positioned within the internal compartment 22 of the housing 16 in a manner as to expo se the silicon window 38 to the generated heat 26. Of course, these insulation layers 48 protect the housing 16 from heat 26 and further reduce heat losses in operation.

In operation, an aircraft 50 is utilized to tow the present invention's aerial target 40 by connecting an elongated tow line 52 thereto. However, it should be recognized by those of ordinary skill in the art that the present target 40 may be adapted for use with a variety of other vehicular structures (e.g., tanks, jeeps, gunboats, manned and unmanned fixed-wing aircraft and helicopters, etc.)

In particular, one end of the tow line 52 is connected to the aircraft 50 while the other end is connected to the fuselage 34. By doing so, the decoy 40 becomes airborne but it should be emphasized that the decoy 40 should be sufficiently distanced from the aircraft 50 (about 2 miles)i so that any incoming missiles do not inadvertently harm the aircraft 50.

When the present decoy 40 is airborne, the heating elements 24 are operative to electrically generate high-intensity heat 26 (about 1,4000° F.) within the internal compartment 22. These heating elements 24 produce radiant heat 26 which is radiated through the silicon window 38 whereat the silicon window 38 allows continuous emission of required infrared signatures 12. These signatures 12 are approximately 40 watts per steradian in the 3–5 micron waveband which are selected frequencies associated with infrared engines. In this respect, military weaponry such as heat-seeking missiles can be launched to trace these signatures 12 for the purpose of striking and destroying the aerial target 40.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. An infrared augmenter device for emitting an infrared thermal signature in a specific waveband range, the device comprising:

a housing having a front end with an opening;

at least one heating element disposed within the housing for generating heat therein; and a silicon window mounted within the opening of the front end and emitting the infrared thermal signature in the specific waveband range when the heat generated within the housing is radiated therethrough.

2. The device of claim 1 wherein the housing is cylindrically configured.

3. The device of claim 1 wherein the housing is fabricated from an aluminum material.

4. The device of claim 1 wherein the housing has a back end and the at least one heating element comprises at least one electrical input terminal, the at least one heating element being connected to the back end via the at least one electrical input terminal extending therethrough.

5. The device of claim 4 wherein the back end of the housing comprises at least one clearance hole for receiving the at least one electrical input terminal therethrough.

6. The device of claim 4 wherein the at least one electrical input terminal is in communication with a electrical power source.

7. The device of claim 1 wherein the at least one heating element comprises three heating elements.

8. The device of claim 7 wherein the three heating elements are concentrically disposed within the housing.

9. The device of claim 1 wherein the at least one heating element has a circular configuration.

10. The device of claim 1 wherein the heat generated within the housing is approximately 1,400 degrees Fahrenheit.

11. The device of claim 1 wherein the housing comprises insulation layers for maintaining the heat generated therein, the insulation layers being selectively positioned within the housing so as to expose the silicon window to the generated heat.

12. The device of claim 1 wherein the front end comprises an inner periphery defining a continuous groove therearound, the silicon window being positioned within the groove so as to be secured thereby.

13. The device of claim 1 wherein the silicon window is an anti-reflective window.

14. The device of claim 1 wherein the silicon window is coated with an anti-reflective material.

15. The device of claim 1 wherein the specific waveband range of the infrared thermal signature is about 3 to 5 microns.

16. An unpowered aerial target for emitting an infrared thermal signature in a specific waveband range when being towed by an aircraft, the target comprising:

a fuselage being connectable to the aircraft for allowing the fuselage to be towed thereby; and an infrared augmenter device engaged to one end of the fuselage and having a silicon window, the silicon window emitting the infrared thermal signature therefrom in the specific waveband range.

17. The device of claim 16 wherein a tow line connects the fuselage to the aircraft.

18. The device of claim 16 wherein a plurality of heating elements are concentrically disposed within the infrared augmenter device for generating heat therein, the silicon window emitting the infrared thermal signature in response to the teat being conducted therethrough.

19. The device of claim 16 wherein the specific waveband range of the infrared thermal signature is about 3 to 5 microns.

20. The device of claim 16 wherein the silicon window is coated with an anti-reflective material.

* * * * *